US005359179A

United States Patent [19]

Desloge et al.

[11] Patent Number: 5,359,179

[45] Date of Patent: Oct. 25, 1994

[54] BAND AND STRIP HEATER CONSTRUCTION WITH VARIABLE LEAD/TERMINAL CONNECTION CAPABILITY

[75] Inventors: George B. Desloge, Frontenac; Raymond H. Fiehler, St. Louis; Keith M. Gegg, Bel-Nor; Steven M. Klump, St. Louis, all of Mo.

[73] Assignee: Watlow Electric Manufacturing Company, St. Louis, Mo.

[21] Appl. No.: 999,459

[22] Filed: Dec. 29, 1992

Related U.S. Application Data

[63] Continuation of Ser. No. 608,242, Nov. 2, 1990.

[51] Int. Cl.[5] ..... H05B 3/58; H05B 3/08

[52] U.S. Cl. ..... 219/535; 219/541; 219/544

[58] Field of Search ..... 219/535, 528, 530, 541, 219/544, 542, 93; 338/311, 314, 243, 247, 249, 254, 255; 392/459

[56] References Cited

U.S. PATENT DOCUMENTS

| | | | |
|---|---|---|---|
| 1,692,164 | 11/1928 | Fromm | 123/142.5 E |
| 2,029,075 | 1/1936 | Knight | 219/535 |
| 2,707,507 | 5/1955 | Tripp et al. | 219/93 |
| 2,845,522 | 7/1958 | Hall | 219/93 |
| 3,475,597 | 10/1969 | Desloge | 219/535 |
| 3,808,573 | 4/1974 | Cappell | 338/249 |
| 3,831,004 | 8/1974 | Wallstrom | 219/535 |
| 3,872,281 | 3/1975 | Krieg et al. | 219/535 |
| 3,889,362 | 6/1975 | Tyler | 29/619 |
| 3,912,907 | 10/1975 | Lodi | 219/535 |
| 4,203,197 | 5/1980 | Crandell | 29/611 |

FOREIGN PATENT DOCUMENTS

| | | | |
|---|---|---|---|
| 364452 | 11/1922 | Fed. Rep. of Germany | 219/535 |
| 806270 | 6/1951 | Fed. Rep. of Germany | 219/535 |
| 394755 | 11/1910 | France | 219/535 |
| 17538 | of 1910 | United Kingdom . | |

OTHER PUBLICATIONS

Patent Abstracts of Japan–vol. 13, No. 241–Jun. 1989 Publication No. JP1051460 on Feb. 27, 1989.

*Primary Examiner*—Bruce A. Reynolds
*Assistant Examiner*—Michael D. Switzer
*Attorney, Agent, or Firm*—Haverstock, Barrett & Roberts

[57] ABSTRACT

A band and/or strip heater assembly which enables the terminal end portions of the electrical heating element to be readily exposed so as to be easily accessible for later connection to any one of a wide variety of lead/-terminal connections. The assembly comprising a heater element having a plurality of end portions associated therewith, electrical insulation material positioned in surrounding relationship on at least two sides of the heater element, a housing member enclosing the heater element and insulation material, an opening extending through at least a portion of the insulating material located adjacent one side of the heater element and through at least a portion of the housing member, the heater element end portions extending through such openings so as to be readily exposed exterior of the housing member. This construction enables the basic heater unit to be fully fabricated and assembled without attaching a particular style of lead/terminal connection thereto. The present invention further includes the construction and operation of several embodiments of a specially adapted add-on lead/terminal cap or connection member which facilitates the adaptation and joinder of a wide variety of lead/terminal options to the present heater assembly. The present construction is likewise adaptable for use with a wide variety of heating elements or winder constructions and likewise enables all electrical connections to the particular lead/terminal option selected to be accomplished by welding. This greatly improves the overall performance and reliability of such heater.

12 Claims, 3 Drawing Sheets

BAND AND STRIP HEATER CONSTRUCTION WITH VARIABLE LEAD/TERMINAL CONNECTION CAPABILITY

This is a continuation of copending application(s) Ser. No. 07/608,242 filed on Nov. 2, 1990.

The present invention relates generally to heaters and, more particularly, to an improved band and strip type heater construction which facilitates the attachment of a wide variety of lead/terminal connections to the finished unit depending upon the particular application and operating needs of the end user. The present heater construction enables a manufacturer to fabricate and assemble a band or strip heater without having any leads or terminal connections attached thereto. Advantageously, the present construction enables the terminal end portions of the electrical resistance wire or heating element housed within the unit to be readily exposed at an intermediate location exterior thereof so as to be easily accessible for later connection to the particular lead/terminal arrangement specified by the end user. Since the lead/terminal configuration may vary widely from one heater application to another, the present construction enables a manufacturer to fully assemble and stock such units without committing such units to a particular lead/terminal arrangement. Thereafter, such units can be easily and quickly equipped with the particular lead/terminal configuration as specified by the end user. This facilitates reductions in the stock inventory requirements of the manufacture and speeds up delivery of the finished product to the end user. This also provides the end user with a much broader selection of suitable heaters from available stock inventories. Although the present heater construction is specifically adaptable for use in the fabrication and assembly of band and strip type heaters, such construction may likewise lend itself to other heater applications.

BACKGROUND OF THE INVENTION

Band and strip heaters are typically custom fabricated in accordance with the particular specifications of the end user. Besides specifying the particular performance characteristics and operating factors desired in a particular heater unit, such as voltage, wattage, power supply, dimensional and other special requirements, the end user also specifies the particular lead or terminal configuration necessary for adaptation of the heater to the particular application in question. A wide variety of lead and/or terminal configurations are available and adaptable for use with band and strip type heaters and such configurations may vary considerably from one application to another. Typical of the known band and strip heater constructions including lead and/or terminal connections associated therewith are those shown and disclosed in U.S. Pat. Nos. 4,203,197; 3,872,281; and 3,889,362.

Since current manufacturing techniques usually mandate that the lead and terminal arrangement for a particular band or strip heater be attached during the assembly process, manufacturers of such heaters have been somewhat reluctant to carry a large stock inventory of such heaters covering a wide variety of such lead/terminal variations. Instead, manufacturers typically wait until receiving a particular order from an end user before manufacturing and assembling such heaters. Consequently, quick delivery of the end product is often times hindered due to the manufacturing process since the manufacturer may not have a heater in stock meeting all of the specifications and requirements of the end user, particularly, the necessary lead and/or terminal configuration as discussed above. As a result, often times, the manufacturer may attempt to modify the lead and/or terminal arrangement associated with heaters already in stock which otherwise meet all of the specifications and requirements of the end user so as to achieve a quicker delivery time. Such modification efforts often times reduce the overall performance and dependability of the modified heater due to disassembly and re-assembly of the lead and/or terminal portion of such heater as well as other factors. The present heater construction alleviates this particular problem by enabling the basic heater to be fabricated and assembled without any lead and/or terminal connection associated therewith as will be hereinafter explained.

During the fabrication and assembly of conventional band and strip heaters, it is also common practice to crimp or stake the terminal end portions of the electrical winding or heater element to the insulation sheet material and/or other components associated therewith for ultimate connection to the particular lead/terminal arrangement utilized. This staking of the electrical resistance means to the particular insulation material utilized within the heater often times causes cracks or other damage to such insulation material. This is particularly true when the heater is curved into a band type heater. This cracking and damage around the staking point decreases performance and reliability of the heater since the winding lead attached thereto has a tendency to loosen, short out, oxidize during operation, and/or cause other performance problems. This problem is likewise alleviated by the present heater construction as will be hereinafter explained.

SUMMARY OF THE INVENTION

The present heater construction overcomes the aforementioned problems and other disadvantages and limitations associated with the construction and assembly of known band and strip heaters and teaches the construction and operation of an improved heater assembly whereby the basic heater unit can be fully fabricated and assembled without attaching a particular style of lead/terminal connection thereto. Contrary to current manufacture, the present heater construction allows the terminal end portions of the heater element located therewithin to be readily exposed outside the metal sheath enclosing the heater components at an intermediate location therealong. This is accomplished by routing the heater element end portions through slot means formed in certain portions of the insulator material housed therewithin as well as through slot means formed in the outer metal sheath associated with such heater. The present heater is assembled and constructed using known techniques, the end result being that a band or strip heater is formed having the two terminal end portions of the heater element extending therefrom for easy accessibility and later connection to a particular lead/terminal configuration.

The present invention further includes the construction and operation of several embodiments of a specially adapted add-on lead/terminal cap or connection member which can be easily attached, both electrically and structurally, to the protruding heater element end portions and the outer metal sheath of the heater. By varying the construction and design of the lead/terminal connection member, all of the various terminal and lead designs available for use with band and strip heaters can be adapted for attachment to the basic heater unit. This is extremely important and beneficial to the manufacturer of such heaters since such heaters can now be easily stocked in inventory without physically attaching a particular type of lead/terminal connection thereto. Thus, when an end user requests a particular lead/terminal configuration, the specified termination arrangement can be quickly adapted and attached to the already completed basic heater unit. This greatly improves turnaround time and delivery of the product to the end user. Such heater termination options typically include the use of any plurality of post terminals, upright leads, upright leads housed within either a loose or a tight stainless steel braid sleeving, upright leads housed within a flexible conduit, upright leads housed within a fiberglass sleeving, terminal box protection, and many other lead and post terminal variations. The present lead/terminal connection members are therefore an important link between the various lead/terminal options and the basic heater construction. The only features of the basic heater unit that are subject to change are the size of the unit, the wattage and/or voltage output, and the attachment location for the add-on lead/terminal cap member, all of which variable features can be easily stocked in inventory.

Besides improving delivery time, the present heater construction also eliminates the need for staking the opposite end portions of the heater element to the insulation material or other heater components. Instead, since the terminal end portions of the heater element are fully exposed and easily accessible outside the unit, all electrical connections to the particular lead/terminal option selected are accomplished by welding. This therefore eliminates the cracking and damage problems at the staking points as previously explained, thereby improving the overall performance and reliability of such heaters. Also, the present heater construction includes clamping or attachment means which simplifies installation and provides for a more uniform load distribution over the heating element. When used as a band heater, the present construction also facilitates the opening or spreading apart of the unit so as to more easily position such unit around the particular cylindrical object or surface to be heated. This can be accomplished without detrimentally affecting the heater itself; without otherwise using a two-piece type band construction; and without utilizing a more expensive expandable type band construction.

The present heater construction is likewise adaptable for use with all of the various known heating elements or winder constructions presently employed in band and strip type heaters. This includes the conventional single wound element arrangement which comprises a single resistance wire wrapped around a sheet of insulator material; the parallel or bifiler wound arrangement which comprises two resistance wires wrapped around a sheet of insulator material; a sinuated wire arrangement wherein the sinuated wire is sandwiched or otherwise embedded between two or more sheets of insulator material; and still other heating element and winder constructions. Also, importantly, the present heater construction is adaptable for use in constructions which utilize any number of insulating layers of material adjacent the opposite sides of the heating element. Such internal heating element and insulator configurations are usually dependent upon the performance characteristics of the heater as well as the particular construction associated with the heating element utilized therein. Also, importantly, the present heater construction is adaptable for use with any type of insulator material such as mica, sheets of organically bound ceramic particles such as aluminum oxide and/or magnesium oxide, and any combinations thereof. Regardless of the internal workings and material composition of such heater, all of the features and capabilities afforded by the present heater construction represent important advancements in the manufacture of band and strip heaters.

It is therefore a principal object of the present invention to teach the construction and operation of an improved band and strip heater construction wherein a wide variety of lead and/or terminal configurations can be easily attached thereto.

Another object is to improve the performance and reliability of band and strip type heaters by eliminating the need to crimp or stake the terminal connection end portions of the heating element to the insulation material or any other component of such heater.

Another object is to teach the construction and operation of several embodiments of a lead/terminal connection member which will facilitate the adaptation and joinder of a wide variety of lead and terminal configurations to the present heater construction.

Another object is to teach the construction and operation of a heater construction which will enable manufacturers of band and strip type heaters to reduce their stock inventory yet still offer their customers a broad selection of such heaters including a broad selection of lead/terminal configurations associated therewith.

Another object is to teach the construction and operation of a heater construction which will reduce and improve the time needed to deliver such heaters to the end user.

Another object is to teach the construction and operation of a heater construction wherein all of the electrical connections associated with such heater are welded connections.

Another object is to teach the construction and operation of a heater construction having clamping means associated therewith which not only provides for a more uniform load distribution over the heating element housed therein but also simplifies the installation of such heater by eliminating the need to align straps and terminals.

Another object is to provide a heater construction that is structurally and operationally relatively simple to make.

Another object is to provide a band heater construction which can be more easily expanded to fit around the particular cylindrical surface to be heated without detrimentally affecting or otherwise interfering with or hindering the overall performance and reliability of such unit.

Another object is to provide a more responsive and reliable heater and one which is not easily susceptible to premature heater failure, erratic, or less than fully dependable performance.

These and other objects and advantages of the present invention will become apparent to those skilled in the art after considering the following detailed specification in conjunction with the accompanying drawings.

DETAILED DESCRIPTION OF THE INVENTION

Figure 1:
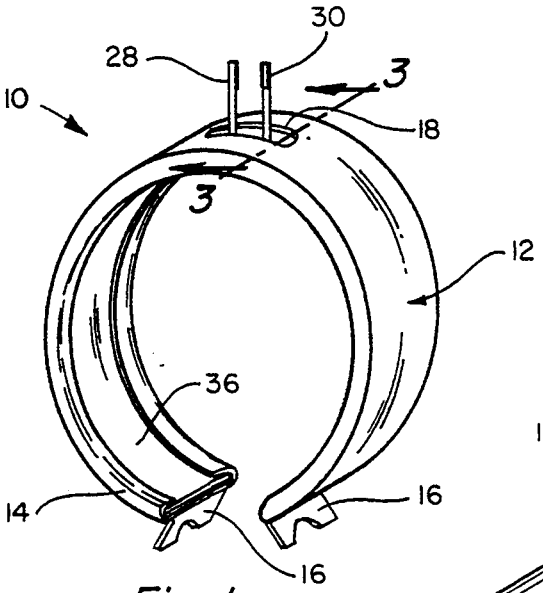
FIG. 1 is a perspective view of a band heater constructed according to the teachings of the present invention, said heater being shown without a lead/terminal connection and without clamping means.
Figure 2:
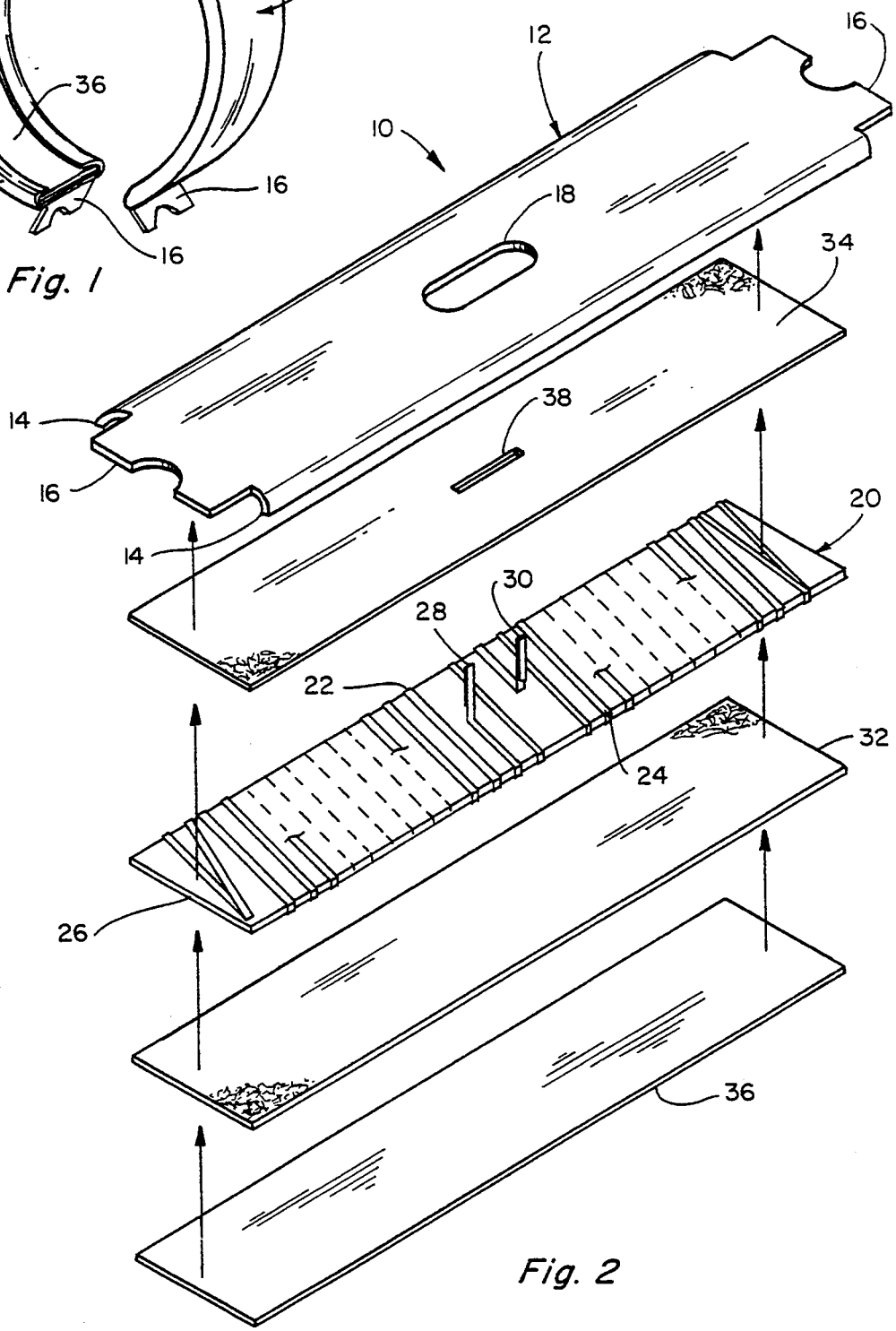
FIG. 2 is an exploded perspective view of one embodiment of the present heater construction showing the various components associated therewith.

Referring to the drawings more particularly by reference numbers, wherein like numerals refer to like parts, number 10 in FIGS. 1 and 2 identifies one embodiment of a basic band or strip heater assembly constructed according to the teachings of the present invention, the heater assembly 10 being manufactured and assembled without termination and attachment means associated therewith. As best shown in FIG. 2, the present heater assembly 10 includes a channel-shaped upper sheath or cover member 12 having a pair of downwardly extending opposed side wall portions 14 associated therewith. The channel-shaped member 12 is generally made of a metallic material and further includes a tab member 16 associated with each respective opposite end portion thereof as well as an elongated slot or opening 18 positioned at an intermediate location therebetween. The heating element 20 is a conventional bifiler winder construction which includes a pair of electrical resistance wires 22 and 24 helically wrapped or wound in parallel relationship around a sheet of insulator material 26. The bifiler wound construction is achieved by first winding the resistance wires 22 and 24 in parallel around the insulator strip 26 from one end to the other in accordance with known techniques and thereafter welding together the respective opposite ends thereof so as to create a closed loop therebetween. This joined wire arrangement is then severed at a predetermined intermediate location as desired thereby forming an electrical circuit having terminal end portions 28 and 30 as shown in FIGS. 1 and 2. The resistance wires 22 and 24 are generally formed of a ribbon of nichrome wire, although any suitable high temperature electrical resistance means can be utilized. The terminal wire end portions 28 and 30 are each preferably doubled over and welded respectively to themselves so as to form a double layer construction at end portions 28 and 30. This lowers the resistance of the wire end portions 28 and 30 and allows such end portions to operate at cooler temperatures at the point of connection to a particular lead/terminal arrangement.

Figure 3:
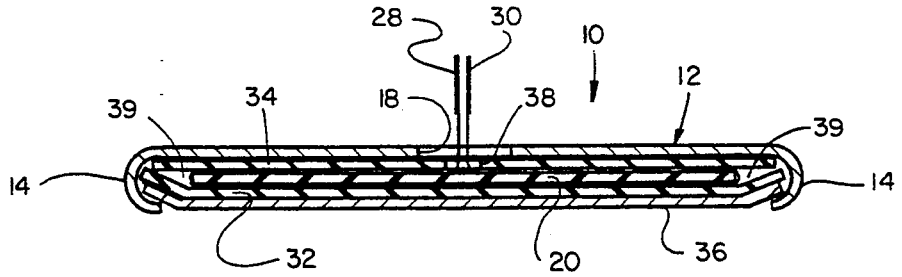
FIG. 3 is a cross-sectional view of an assembled heater unit taken, for example, along line 3—3 of FIG. 1.

The heating element 20 is sandwiched between two strips or sheets of insulation material 32 and 34 which effectively insulate the heating element 20 from the metallic heat conducting parts 12 and 36 as will be hereinafter explained. The upper insulator sheet 34 likewise includes an elongated slot 38 positioned thereon so as to receive the terminal end portions 28 and 30 of the heating element 20 when positioned in overlaying relationship thereto. Slot 38 is also located so as to lie in registration with slot 18 associated with the cover member 12. Insulator sheets 26, 32 and 34 are typically comprised of either mica or high density ceramic particles bound together by a suitable binder, or any other suitable insulating material. The ceramic particles typically include particles of aluminum oxide, magnesium oxide, boron nitride, or silicon dioxide. All of these materials have excellent dielectric strength, the ceramic materials being capable of operating at somewhat higher temperatures as compared to mica and some other known suitable materials. When fully assembled, the terminal end portions 28 and 30 of the heating element 20 extend through the respective slot means 38 and 18 as best shown in FIGS. 1 and 3. A bottom cover plate 36 completes the components of the basic heater unit 10. The plate member 36 is likewise generally made of a metallic material and is dimensioned so as to be received within the channel-shaped cover member 12.

In assembling the basic heater 10, the sandwich subassembly or heater core body comprising heating element 20 and insulator sheets 32 and 34 is placed within the channel-shaped cover member 12 such that the heating element terminal end portions 28 and 30 extend through slot means 38 and 18 and are readily exposed exterior of the member 12. Plate member 36 is now positioned within the channel-shaped member 12 in abutment with the insulator sheet 32. In this regard, the plate member 36 and the insulator sheets 32 and 34 are of about the same length and width as the channel-shaped cover member 12 so as to fit snugly therewithin. On the other hand, the insulator sheet 26 associated with the heating element 20, while about the same length as the cover member 12, is preferably somewhat narrower than insulator strips 32 and 34 so as to provide a small gap 39 (FIG. 3) for electrical clearance between the resistance means 22 and 24 and the channel side portions 14. When so positioned, the channel side portions 14 are folded tightly inwardly over plate member 36 to close the assembly as shown in FIG. 3. The members 12 and 36 thereby form a sheath totally enclosing and encasing the internal components of the heater. The closed assembly is then rolled flat or is formed into a curved finished shape in accordance with known procedures. The assembly may be shaped, for example, into the configuration of a curved band heater as shown in FIG. 1, or the assembly may be left in its extended form so as to be completed as a strip heater (not shown). After the forming step, the assembly is normally fired at an elevated temperature sufficient to vaporize and bake out the binder materials associated with the insulator sheets 26, 32 and 34.

The sheath members 12 and 36 are typically constructed of selected metals to provide high reflectivity, high emissivity and good conductive characteristics to efficiently transmit heat from the core element 20 towards the plate member 36 which lies adjacent to the particular object or surface to be heated. For example, the channel-shaped cover member 12 is typically made of aluminized steel which has a highly reflective surface thereby directing the heat from the heater element 20 back towards the part or surface to be heated. In contrast, the plate member 36 is typically made of a zinc coated metal which has good emissivity. This increases the heat transfer rate through this relatively thin layer of metal to the part or surface to be heated. Also, the thickness of the insulation material positioned between the outer sheath member 12 and the heating element 20 can be made greater as compared to the thickness of insulation sheet 32 so as to further direct the heat generated by the heater element 20 towards the plate member 36. Also, the insulator strips 26, 32 and 34 can be comprised of different material compositions to further enhance the heat transfer capabilities of the unit. All of these various combinations contribute to the overall efficiency of the heater.

As can be seen from FIGS. 1 and 3, the terminal end portions 28 and 30 of the heater element 20 are readily exposed exterior of the upper cover member 12 for easy access and later connection to any one of a plurality of lead/terminal configurations as will be hereinafter explained. The heater construction 10 can be fully manufactured and stocked in such manner. Once an end user specifies a particular lead/terminal arrangement, such heaters can then be easily and quickly equipped to fill such order. This is extremely advantageous for all of the reasons previously explained.

Figure 4:
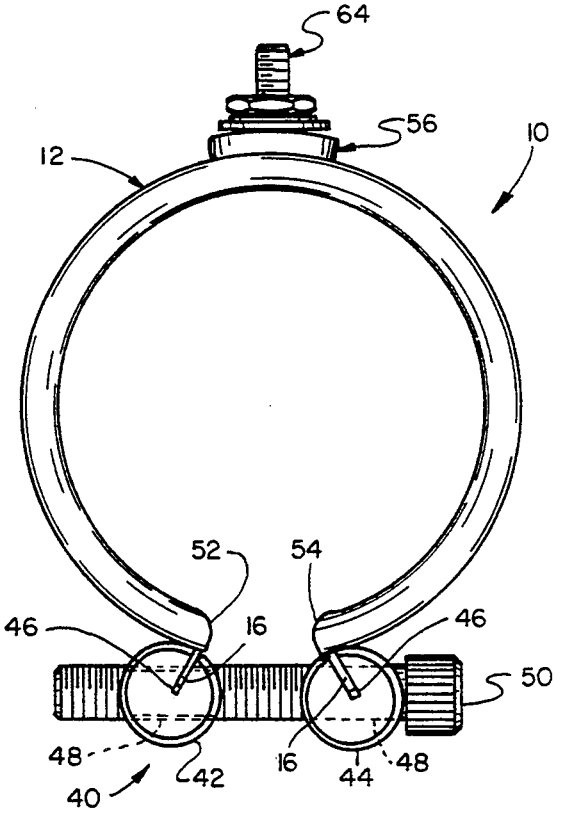
FIG. 4 is a side elevational view of the band heater construction illustrated in FIG. 1 showing the clamping means and one embodiment of a terminal arrangement associated therewith.
Figure 5:
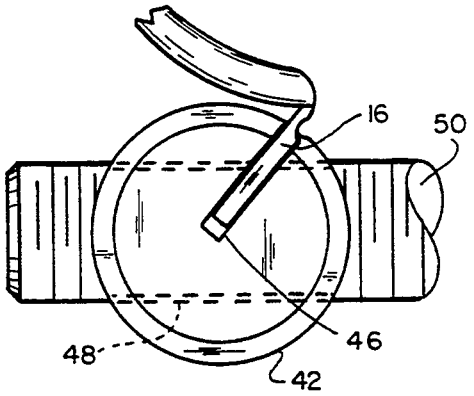
FIG. 5 is an enlarged fragmentary view of one of the clamping bars shown in FIG. 4 illustrating its attachment to one of the tab members associated with the outer metal sheath of the present construction.

FIGS. 4 and 5 illustrate the construction and design of an improved clamping means 40 particularly adaptable for use on a band type heater such as the basic band heater construction 10 illustrated in FIG. 1. More particularly, clamp or attachment means 40 includes a pair of clamp bar members 42 and 44 each having an elongated slot 46 extending the full length thereof. The members 42 and 44 are each respectively attached to the outer cover member 12 through use of the tab members 16, each slot 46 being dimensioned so as to insertably receive the tab 16 as best shown in FIG. 5. Once the tab members 16 are engaged with the bar members 42 and 44, such members are then attached to each other by a staking or crimping process as illustrated in FIG. 5.

Each bar member 42 and 44 likewise includes an opening 48 extending transversely therethrough at an intermediate location therealong, each such opening 48 being in registration with each other and at least one of such openings 48 being adaptable to threadably receive a threaded fastening member such as the member 50 (FIG. 4). Threading the fastener member 50 through at least one threaded bore 48 such as the threaded bore 48 extending through the bar member 42 (FIG. 5) will draw the respective terminal end portions 52 and 54 of the heater 10 towards each other thereby securely fastening and clamping the heater 10 around the cylindrical object over which it is positioned. Although only the opening 48 extending through bar member 42 (FIGS. 4 and 5) need be threaded in order to accomplish this task, it is also recognized that the opening 48 extending through bar member 44 may likewise be threaded if so desired. When fully secured around the object to be heated, the tab members 16 carry and distribute the load over the entire unit by means of the outer sheath member 12, thus eliminating the use of straps and other clamping mechanisms. This provides a more uniform load distribution over the internally housed heating element 20 and draws the heater tightly and evenly to the cylindrical surface to which it is attached. This assures a critical mating of the heater surface to the cylindrical surface to which it is attached thereby eliminating air gaps that can cause early failures. Depending upon the overall width of the particular band heater involved, each bar member 42 and 44 may include any plurality of openings 48 spaced along the length thereof, each such opening on bar member 42 being in registration with a corresponding opening positioned on bar member 44 and each such respective pairs of openings 48 being adaptable to receive a threaded fastening member as previously described. This will provide sufficient clamping means to securely and evenly fasten wider heater units around the surface over which they are positioned along their entire width. The clamp mechanism 40 also simplifies the installation of such heaters by eliminating the need to align straps and terminals commonly associated with other clamping means.

Figure 7:
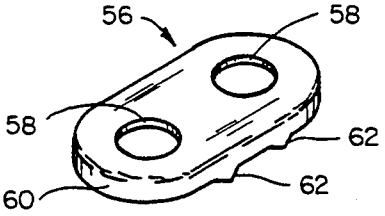
FIG. 7 is a perspective view of the terminal cap member illustrated in FIG. 6.
Figure 6:
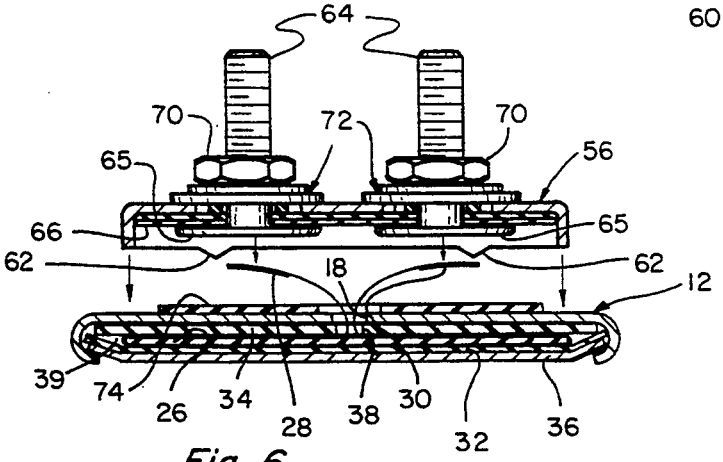
FIG. 6 is an exploded cross-sectional view showing one embodiment of a terminal connection adaptable for use with the heater assembly of the present invention.

FIGS. 6 and 7 illustrate one embodiment of a specially adapted add-on terminal connection member 56 specifically adaptable for use when the termination option calls for a post terminal arrangement. The terminal connection or cap member 56 is somewhat oval in shape and includes a pair of openings 58 extending therethrough as best shown in FIG. 7. The cap member 56 is formed of an aluminized steel material and likewise includes a downwardly extending peripheral flange or skirt portion 60 having a pair of triangularly-shaped weld projections or dimples 62 located respectively on at least two opposite sides thereof as best illustrated in FIG. 7. A pair of post terminals 64 each having a flanged head portion 65 associated respectively therewith are insertably positioned through the openings 58 of the cap member 56 in such a way that both the terminals and the cap member are electrically isolated. This is accomplished by positioning a pair of insulator members 66 and 68 between the flanged head portions 65 of the post terminals 64 and the inside portion of the cap member 56 as shown in FIG. 6. Each of the insulator members 66 and 68 is preferably oval in shape so as to fit within the formed flange portion of the cap member 56 and each includes a pair of openings extending therethrough adapted to receive the post terminals 64 when inserted therethrough. The openings associated with insulator members 66 and 68 are positioned and located thereon so as to be in registration with the openings 58 associated with the cap member 56. Once the post terminals 64 are shielded by the insulator members 66 and 68 and are thereafter inserted through the openings 58 as shown in FIG. 6, such terminals are held in engagement with the cap member 56 through use of the locking nut members 70 or other suitable locking means. To further insulate the post terminals 64 from the upper surface portion of the cap member 56, any number of suitable insulating washers may be positioned therebetween such as the respective pairs of washers 72 illustrated in FIG. 6. Although a particular construction and arrangement of insulator members 66, 68 and 72 are disclosed and described with respect to the post terminal configuration illustrated in FIG. 6, it is recognized that a wide variety of other suitable means may likewise be utilized to electrically insulate the terminals 64 from the cap member 56.

Importantly, the post terminal option illustrated in FIG. 6 is fully assembled prior to connection to the basic heater unit 10. During such installation, the heating element end portions 28 and 30 are inserted through a slotted insulator member 74 so as to insulate the same from the outer cover member 12 as illustrated in FIG. 6. In this regard, the insulator member 74 should be shaped and dimensioned so as to preferably completely cover the slot means 18. Like the insulator members 26, 32 and 34 (FIG. 2), each of the insulator members 66, 68, 72 and 74 is preferably made of a ceramic material or mica, although other suitable insulating materials may likewise be utilized. The heater element end portions 28 and 30 can now each be welded respectively to the bottom of one of the flanged head portions 65 of the post terminals 64 using a special welding technique. After completing such welds, the terminal cap member 56 is then welded to the outer metal sheath member 12 through use of the weld projections or dimples 62. This weld is made with one operating cycle of a suitable welding machine. More particularly, the welder current is concentrated at the various projections 62 thus causing each projection to melt, thereby creating a fusion bond with the cover member 12. This welding process permanently attaches the terminal cap member 56 to the outer sheath member 12.

The terminal cap member 56 provides a base to rigidly hold the post terminals 64 and, once such member is installed on the basic heater unit 10, it gives electrical protection to the welded connection between the resistance wires 28 and 30 and the post terminals 64. Also, importantly, the cap member 56 enables increased torque to be applied to the post terminal connection. This allows all of the torque carrying capability to be maintained within the cap design independent of its electrical connection to the basic heater unit. Also, the post terminal hardware 64 and 70 can be torqued to a specific setting and tested prior to connection to the actual heater. This greatly improves the reliability and performance of the overall heater. Also, since the heater element end portions 28 and 30 are welded to the post terminals 64, all electrical connections within the heater assembly are welded connections. This obviates the need to utilize other electrical connection means such as crimping or staking the heater element end portions to other components associated with the heater. This greatly improves the performance and reliability of such heaters and helps to eliminate premature heater failure.

Figure 9:
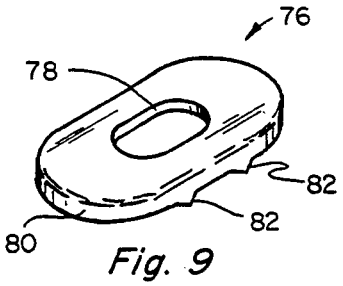
FIG. 9 is a perspective view of the lead cap member illustrated in FIG. 8.
Figure 8:
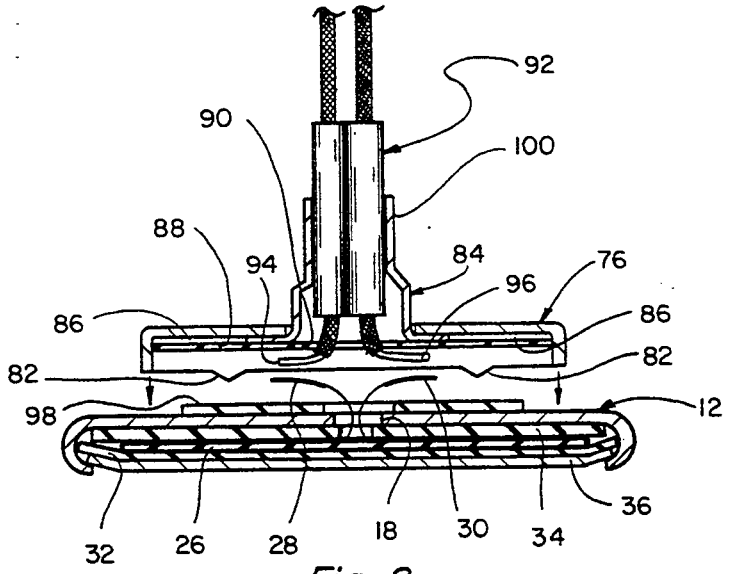
FIG. 8 is an exploded cross-sectional view showing another embodiment of a lead/terminal connection adaptable for use with the heater assembly of the present invention.

FIGS. 8 and 9 illustrate another embodiment of a specially adapted add-on lead connection member 76 specifically adaptable for use when the termination option calls for any one of a plurality of various lead termination arrangements. The lead connection or cap member 76 is substantially identical in shape and construction as cap member 56 except that the member 76 includes only a single opening 78 extending therethrough as best shown in FIG. 9. The opening 78 is of sufficient size and shape to accept the various known lead wire arrangements including lead wires housed in various conduit and sleeving devices. In this regard, it is recognized that the lead cap member 76 can be made and stocked with various sized openings 78 depending upon the particular diameter or other shape associated with the lead configuration selected. Like the terminal cap member 56, the lead cap member 76 is likewise formed of an aluminized steel material and includes a peripheral flange or skirt portion 80 having similarly located triangularly-shaped weld projections or dimples 82 associated therewith as best illustrated in FIG. 9.

The lead assembly arrangement illustrated in FIG. 8 includes a generally cylindrically-shaped eyelet member 84 having a flanged lower portion 86 associated therewith, the eyelet member 84 being insertably positioned through the opening 78 as illustrated. The lower flange portions 86 are welded to the inside portion of the lead cap member 76 and a suitably dimensioned insulator member such as the member 88 is positioned thereover within the formed flange portion of the cap member 76 as illustrated in FIG. 8. The insulator member 88 includes an opening 90 of approximately the same dimension as the opening through the eyelet member 84 and functions to insulate the end portions of the lead termination wires from the inside portion of the cap member 76. As can be seen from FIG. 8, the opening 90 associated with the insulator member 88 is positioned and located so as to be in registration with the opening associated with the eyelet member 84. The appropriate lead wire arrangement is now inserted through the insulator member 88 and the eyelet member 84. As shown in FIG. 8, the lead wires are encased in a protective sleeving member 92 and the respective stranded wire end portions 94 and 96 are suitably flattened for joinder to the heating element end portions 28 and 30 as will be hereinafter described. The wire end portions 28 and 30 are thereafter inserted through a slotted insulator member 98 similar to the insulator member 74 (FIG. 6), which insulator member 98 is positioned over the outer sheath member 12 (FIG. 8) so as to insulate the same from the electrical connection formed by joinder of the wire end portions 28, 30, 94 and 96. The heating element end portions 28 and 30 are then suitably welded to the flattened lead wire end portions 94 and 96 to complete the electrical connection therebetween. The lead cap member 76 is thereafter projection welded to the outer cover member 12 as previously described and the eyelet member 84 is suitably crimped about the sleeving member 92 adjacent its upper end portion 100 so as to provide suitable strain relief to the welded electrical connection.

As with the post terminal configuration illustrated in FIG. 6, the insulator members 88 and 98 illustrated in FIG. 8 are likewise made of a suitable insulating material such as a ceramic material or mica as previously described. Likewise, although a particular lead termination construction and arrangement is illustrated in FIG. 8, such configuration is likewise generally adaptable for use with most of the lead wire termination options available. It is also recognized that a wide variety of other suitable insulator and eyelet constructions and arrangements may likewise be utilized in conjunction with the lead cap member 76 (FIGS. 8 and 9). Nevertheless, regardless of the particular component structure and arrangement, lead cap member 76 fulfills all of the objectives and advantages previously described with respect to cap member 56.

Figure 10:
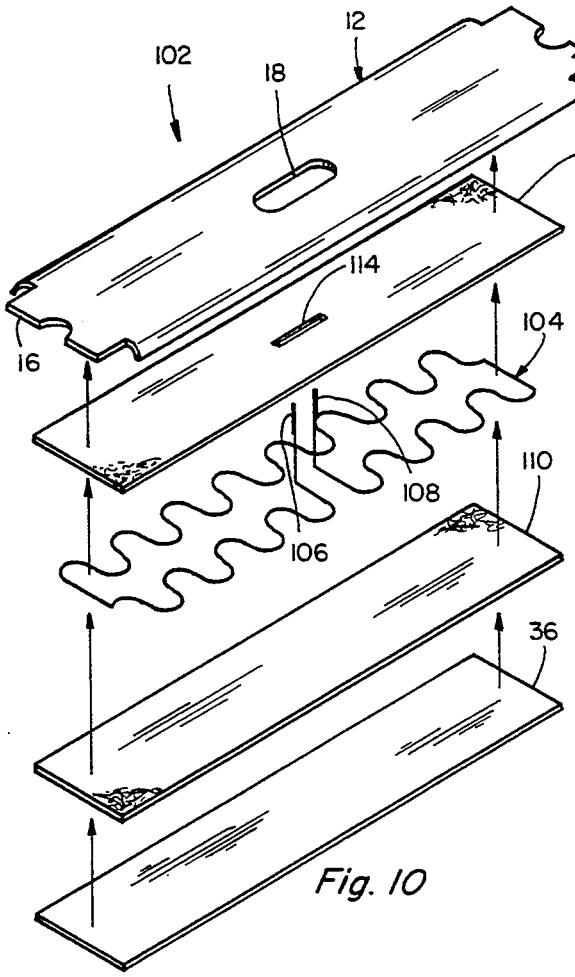
FIG. 10 is an exploded perspective view similar to FIG. 2 showing another embodiment of a heater assembly constructed according to the teachings of the present invention.
Figure 11:
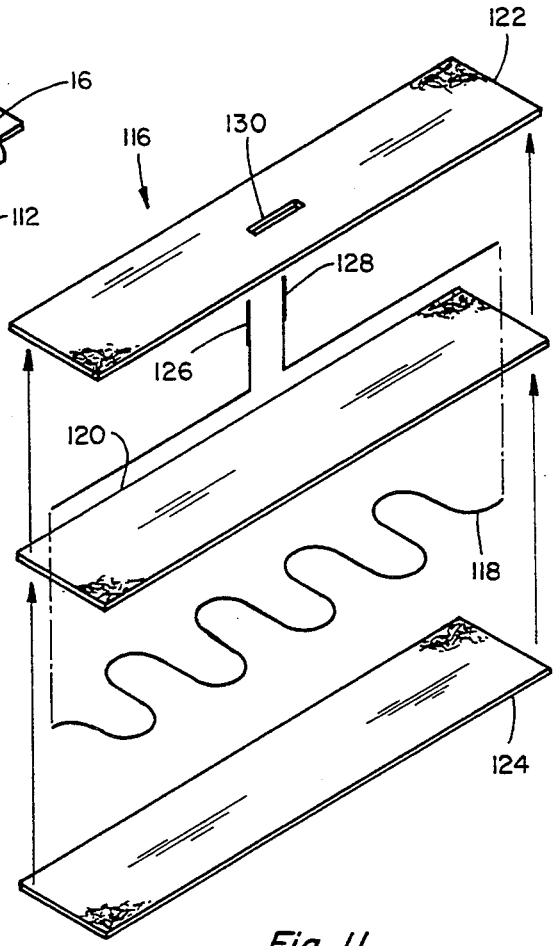
FIG. 11 is an exploded perspective view of still another heating element/insulator arrangement constructed according to the teachings of the present invention.

FIGS. 10 and 11 illustrate still other embodiments of the present heater assembly constructed according to the teachings of the present invention. More particularly, FIG. 10 identifies embodiment 102 which illustrates the use of a sinuated wire element construction in conjunction with the present heater assembly. As shown, a pair of sinuated wires 104 having terminal end portions 106 and 108 are sandwiched between a pair of insulator members 110 and 112. The upper insulator member 112, like the insulator member 34 (FIG. 2), also includes an elongated slot 114 positioned thereon so as to receive therethrough the heating element end portions 106 and 108 when the member 112 is positioned in overlaying relationship thereto as illustrated in FIG. 10. The heating element 104 is not wrapped or wound about a sheet or strip of insulator material. Instead, embodiment 102 utilizes only two layers of insulating material in such heater construction as compared to the three insulating layers utilized in the embodiment illustrated in FIG. 2. In all other respects, the heater assembly 102 is substantially identical to the basic heater construction previously described and illustrated in FIGS. 1–5.

FIG. 11 identifies embodiment 116 which illustrates use of a single resistance wire 118 sandwiched between two upper insulator members 120 and 122 and a single lower insulator member 124. As shown in FIG. 11, the opposite end portions of the wire element 118 are routed either around or through the respective opposite end portions of insulator member 120 and across the upper surface thereof such that the terminal end portions 126 and 128 are centrally located thereabove. It is recognized that if the opposite end portions of the wire element 118 are routed through insulator member 120, suitable openings (not shown) for receiving the same therethrough would be formed adjacent the respective opposite ends of member 120. Insulator member 122 includes an elongated slot 130 positioned thereon so as to receive therethrough the heating element end portions 126 and 128 when positioned in overlaying relationship with insulator member 120. In this particular construction, the use of an additional insulator member 120 is necessary in order to insulate the return portions of the heating element 118 from itself as illustrated. It is also anticipated that heating element 118 may be so arranged that its end portions 126 and 128 may both be routed either around or through only one end portion of insulator member 120 and thereafter extend across the upper surface thereof to an intermediate location as previously explained. In all other respects, the heater construction illustrated in FIGS. 1–5.

Besides the heating element and winder constructions illustrated in FIGS. 2, 10 and 11, it is recognized that the present heater construction is likewise adaptable for use with still other heating element and winder constructions including use with constructions utilizing any plurality of insulating members therewithin. In all cases, however, the termination/lead cap members 56 and 76 may be utilized with such heater constructions to achieve the attachment of any particular type of lead/terminal configuration to the finished unit as previously described.

Thus, there has been shown and described several embodiments of a novel heater construction for use primarily in the manufacture of band and strip type heaters, which constructions fulfill all of the objects and advantages sought therefor. Many changes, modifications, variations, and other uses and applications of the present heater constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A band or strip heater assembly comprising a heating element having a plurality of end portions associated therewith, at least one sheet of insulation means positioned adjacent one side of said heating element, at least one sheet of insulation means positioned adjacent the opposite side of said heating element, a housing member enclosing said heating element and said insulation means, slot means extending through at least a portion of said insulation means located adjacent one side of said heating element and through at least a portion of said housing member for receiving said plurality of heating element end portions, the slot means associated with said insulation means being smaller than the slot means associated with said housing member, said plurality of heating element end portions extending through said slot means so as to be readily exposed exterior of said housing member after said heater assembly has been fully assembled and sealed, said plurality of heating element end portions being of the same gauge as that of the rest of said heating element and being of the same resistance per unit of length as that of the rest of said heating element, terminal connection means selectively attachable to said exposed heating element end portions after said heater assembly has been fully assembled and sealed, said terminal connection means including a downwardly extending peripheral flange having a terminal edge portion associated therewith positioned and located for making contact with said housing member when said terminal connection means is positioned for attachment thereto, said downwardly extending peripheral flange including a plurality of downwardly extending weld projections positioned and spaced along the terminal edge portion thereof for facilitating the welding of said terminal connection means to said housing member, said weld projections extending below the terminal edge portion of said peripheral flange so as to make the first contact with said housing member when said terminal connection means is positioned for attachment thereto, each downwardly extending weld projection being meltable during a welding process so as to form a fusion bond thereat with said housing member.

2. The heater assembly defined in claim 1 wherein said heating element includes a single resistance wire wrapped around a sheet of insulation means.

3. The heater assembly defined in claim 1 wherein said heating element includes a plurality of resistance wires wrapped around a sheet of insulation means.

4. The heater assembly defined in claim 1 wherein said insulation means includes mica.

5. The heater assembly defined in claim 1 wherein said insulation means includes sheets of organically bound ceramic particles held together in a suitable heat dissipatable binder material.

6. A heater assembly comprising a heating element having end means associated therewith, a first insulator member positioned in abutting relationship adjacent one side of said heating element, a second insulator member positioned in abutting relationship adjacent the opposite side of said heating element, an upper cover member positioned in abutting relationship with said first insulator member, said upper cover member having a pair of downwardly extending opposed side wall portions associated therewith, a lower cover member positioned in abutting relationship with said second insulator member, said lower cover member being dimensioned so as to be received between the downwardly extending opposed side wall portions of said upper cover member, said first insulator member and said upper cover member each including an opening extending respectively therethrough, the opening in said upper cover member being larger than the opening in said first insulator member said heating element end means extending through the respective openings in said first insulator member and said upper cover member so as to be readily exposed exterior of said upper cover member, the downwardly extending opposed side wall portions of said upper cover member being folded inwardly over the outer surface of said lower cover member to close said assembly, said heating element and its associated end means being uniform in width and thickness and being uniform in resistance per unit of length, and any one of a plurality of different types of terminal connection means being selectively attachable to said exposed heating element end means after said heater assembly is closed and sealed, said selected terminal connection means further including a downwardly extending peripheral flange having a terminal edge portion associated therewith positioned and located for making contact with said housing member when said terminal connection means is positioned for attachment thereto, said downwardly extending peripheral flange including a plurality of downwardly extending weld projections positioned and spaced along the terminal edge portion thereof for facilitating the welding of said terminal connection means to said housing member, said weld projections extending below the terminal edge portion of said peripheral flange so as to make the first contact with said housing member when said terminal connection means is positioned for attachment thereto, each downwardly extending weld projection being meltable during a welding process so as to form a fusion bond thereat with said housing member.

7. The heater assembly defined in claim 6 wherein said heating element includes at least one resistance wire.

8. The heater assembly defined in claim 6 wherein said heating element includes at least one resistance wire wrapped around a third insulator member.

9. The heater assembly defined in claim 6 wherein said upper cover member includes a tab member associated with each respective opposite end portion thereof, each of said tab members being engageable with means for securely fastening said heater assembly to a selected surface to be heated.

10. A heater assembly comprising a heating element having at least a pair of end portions associated therewith, a first dielectric member positioned adjacent one side portion of said heating element, a second dielectric member positioned adjacent the opposite side of said heating element so as to sandwich said heating element between said first and second dielectric members, the end portions of said heating element extending from at least one of the opposite end portions of said second dielectric member adjacent the lower surface thereof and further extending across the upper surface portion thereof such that said heating element end portions are located intermediate the respective opposite end portions of said second dielectric member adjacent the upper surface portion thereof, a third dielectric member positioned adjacent the upper surface portion of said second dielectric member so as to sandwich said heating element end portions therebetween, said heating element and said dielectric members being securely held and enclosed within a housing member, said third dielectric member and said housing member each including slot means enabling said heating element end portions to extend respectively therethrough so as to be readily exposed exterior of said housing member at a location intermediate the opposed end portions thereof, the slot means associated with said third dielectric member being narrower than the slot means associated with said housing member, said heating element including its end portions being uniform in width and thickness and uniform in resistance per unit of length, said heating element end portions being capable of ready selective attachment to any one of a plurality of different types of terminal connection means, said terminal connection means being attachable to said heating element end portions after said heater assembly is fully assembled and further including a downwardly extending peripheral flange having a terminal edge portion associated therewith positioned and located for making contact with said housing member when said terminal connection means is positioned for attachment thereto, said downwardly extending peripheral flange including a plurality of downwardly extending weld projections positioned and spaced along the terminal edge portion thereof for facilitating the welding of said terminal connection means to said housing member, said weld projections extending below the terminal edge portion of said peripheral flange so as to make the first contact with said housing member when said terminal connection means is positioned for attachment thereto, each downwardly extending weld projection being meltable during a welding process so as to form a fusion bond thereat with said housing member.

11. The heater assembly defined in claim 10 wherein said heating element end portions extend around at least one of the respective opposite end portions of said second dielectric member.

12. The heater assembly defined in claim 10 wherein said second dielectric member includes means enabling said heating element end portions to extend therethrough adjacent at least one of the respective opposite end portions thereof.

* * * * *

UNITED STATES PATENT AND TRADEMARK OFFICE

CERTIFICATE OF CORRECTION

PATENT NO. : 5,359,179

DATED : October 25, 1994

INVENTOR(S) : George B. Desloge, et al

It is certified that error appears in the above-indentified patent and that said Letters Patent is hereby corrected as shown below:

Column 11, line 45, before "construction", insert --assembly 116 is substantially identical to the basic heater--.

Signed and Sealed this

Twentieth Day of December, 1994

*Attest:*

Bruce Lehman

BRUCE LEHMAN

*Attesting Officer*

*Commissioner of Patents and Trademarks*